United States Patent [19]

Saito et al.

[11] 4,401,533

[45] Aug. 30, 1983

[54] SURFACE-TREATMENT OF CARBON FIBER

[75] Inventors: Kazuhisa Saito; Hiroyasu Ogawa; Tetsuro Shigei, all of Shizuoka, Japan

[73] Assignee: Toho Belson Co., Ltd., Tokyo, Japan

[21] Appl. No.: 240,669

[22] Filed: Mar. 5, 1981

[30] Foreign Application Priority Data

Mar. 5, 1980 [JP] Japan ..... 55-27720

[51] Int. Cl.[3] ..... C25F 1/00

[52] U.S. Cl. ..... 204/130; 428/367

[58] Field of Search ..... 204/130, 132; 428/367, 428/368

[56] References Cited

U.S. PATENT DOCUMENTS 1,378,834 5/1921 Bullock ..... 204/10
3,671,411 6/1972 Ray et al. ..... 204/130
3,759,805 9/1973 Chapman et al. ..... 204/130
4,234,398 11/1980 Yamamoto ..... 204/130

*Primary Examiner*—F. Edmundson
*Attorney, Agent, or Firm*—Sughrue, Mion, Zinn, Macpeak and Seas

[57] ABSTRACT

A method for producing carbon fibers exhibiting excellent adhesive properties to resins and having high strength and heat-oxidation resistance, comprising electrically treating high strength carbon fiber in an aqueous solution of a sulfuric acid salt under conditions such that the current density is from about 0.05 to 0.5 A/m$^2$ and the product of current density, voltage, and processing time is from about 0.02 to 8 A-V-min/m$^2$, while continuously moving the carbon fiber as an anode in the aqueous solution.

11 Claims, 2 Drawing Figures

SURFACE-TREATMENT OF CARBON FIBER

FIELD OF THE INVENTION

This invention relates to a surface-treatment to obtain a carbon fiber exhibiting good adhesive properties to resins, and more particularly to a method for producing a carbon fiber exhibiting good adhesive properties to resins and having high strength and heat-oxidation resistance by electrically surface-treating a high strength type of carbon fiber in an aqueous sulfuric acid salt solution.

BACKGROUND OF THE INVENTION

In general, carbon fibers are light weight fiber materials having high tensile strength and elasticity, and can be classified into the types of high tensile strength carbon fiber, wherein the tensile modulus is from about 20,000 to 28,000 Kg/mm$^2$, and high elasticity carbon fiber, wherein the tensile modulus is at least about 30,000 Kg/mm$^2$. Thus, depending upon the characteristics thereof, it can be used as a reinforcing material for various plastic materials for use in production of spacecraft structural materials, car and industrial machine parts, and so forth. These carbon fibers, however, are required to have good adhesive properties to matrix resins as well as high strength and heat-oxidation resistance.

In order to increase the adhesion of carbon fibers to resins, it is usually necessary to surface-treat the carbon fiber, and various methods have heretofore been proposed. Of these methods, a so-called electrolytic processing method wherein a current is passed through a carbon fiber in an aqueous solution of an electrolyte, such as sodium hydroxide, sulfuric acid, or phosphoric acid, has been considered to be advantageous from an economic standpoint. Such electrolytic processing methods are described, for example, in Japanese Patent Publication No. 40119/72 and U.S. Pat. Nos. 3,671,411 and 3,759,805.

These electrolytic processing methods, however, are liable to deteriorate the inherent strength and heat-oxidation resistance of the carbon fiber, although they do improve the adhesion of the carbon fiber to resins. In particular, it has been found that application of such known electrolytic processing methods to the so-called high strength type of carbon fiber having a tensile modulus of from about 20,000 to 28,000 Kg/mm$^2$ results in a great deterioration of its inherent high strength and heat-oxidation resistance. As has already been described above, however, a carbon fiber is generally required to exhibit not only good adhesion to resins, but also at the same time to have high tensile strength and heat-oxidation resistance, in view of the applications in which it is used.

SUMMARY OF THE INVENTION

The object of this invention is to provide a method of surface-treating a carbon fiber to improve its adhesive properties of resins without deteriorating its tensile strength and heat-oxidation resistance.

As a result of extensive investigation to overcome the above-described problems, it has been found that the adhesion of a carbon fiber to resins, and its tensile strength and heat-oxidation resistance depend not only on the modulus of the carbon fiber to be surface-treated, the type of an electrolyte, and the electrolyte remaining in the carbon fiber after the surface-treatment, but also on the current application conditions, particularly the current density and the extent of the surface-treatment.

This invention, therefore, provides a process for production of a carbon fiber having good adhesive properties to resins and high tensile strength and heat-oxidation resistance. According to this method, a carbon fiber is surface-treated by passing a current therethrough at a current density of from about 0.05 to 0.5 amps/meter$^2$ (A/m$^2$) and in such a manner that the product of the current density, voltage (V), and a processing time (min) is from about 0.02 to 8 A-V-min/m$^2$, while continuously moving the carbon fiber as an anode in an aqueous solution of a sulfuric acid salt.

According to this invention, the adhesion of the carbon fiber to resins can be improved without deteriorating its high strength and heat-oxidation resistance. Thus, the carbon fiber surface-treated in accordance with this invention can be used as a reinforcing material for various plastic materials, e.g., for use in production of spacecraft structural materials, car parts, and so forth.

DETAILED DESCRIPTION OF THE INVENTION

Figure 1:
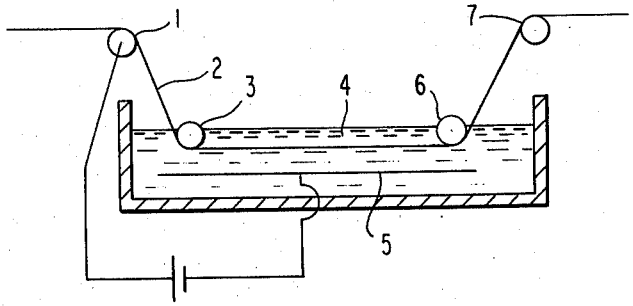
FIG. 1 is a schematic illustration in section of an apparatus in which a carbon fiber is surface-treated by electrolysis according to one embodiment of this invention.

By the term "voltage (V)" as herein used refers to the maximum voltage between a carbon fiber, which is immersed into an aqueous sulfuric acid salt solution, to be surface-treated and a cathode in the aqueous sulfuric acid salt solution.

"High strength carbon fiber" as used herein refers to a tensile modulus of from about 20,000 to 28,000 Kg/mm$^2$. It can be prepared by oxidizing an acrylic fiber at about 200° C. to 400° C. in an oxidizing atmosphere and then carbonizing at about 1,000° C. to 2,000° C. in an inert gas atmosphere, and its tensile strength is at least about 250 Kg/mm$^2$. Such high strength carbon fiber usually has a diameter of from about 5 to 15 $\mu$m. According to this invention, these carbon fibers are typically surface-treated in the form of a fiber bundle comprising from about 1,000 to 50,000 single filaments.

Sulfuric acid salts as used herein include hydrogensulfates. Examples of such sulfuric acid salts include ammonium sulfate, ammonium hydrogensulfate, sodium sulfate, and sodium hydrogensulfate. They are used alone or in combination with each other. Preferred examples are ammonium sulfate, ammonium hydrogensulfate, a mixture of ammonium sulfate and ammonium hydrogensulfate, and mixtures of ammonium sulfate or ammonium hydrogensulfate and another sulfuric acid salt.

When such ammonium salts are used, it seems that groups such as $-NH_2$ and $=NH$ are formed on the surface of the carbon fiber, thereby improving the adhesion of the carbon fiber to an epoxy resin, a polyamide resin, and the like. The use of an aqueous sulfuric acid salt as an electrolyte permits performing the electrolytic processing under moderate conditions, and minimizes the adverse influences of a very small amount of electrolyte which remains even though being washed with water after the electrolytic surface-treatment. Thus, the carbon fiber surface-treated according to this invention still possesses its inherent high strength and heat-oxidation resistance.

For example, when a high strength carbon fiber is surface-treated by the use of a strong base or a strong acid, such as sodium hydroxide, sulfuric acid, or phosphoric acid, the electrolytic processing is inevitably carried out under severe conditions, and the electrolyte remaining after water-washing exerts adverse influences. As a result, the high strength and heat-oxidation resistance that the carbon fiber possesses inherently are greatly deteriorated, and the residual electrolyte exerts further adverse influences, such as with respect to hardening of an epoxy resin, a polyester resin, etc., and inhibiting the compatibility of the carbon fiber with other resins.

With regard to the conditions under which the aqueous sulfuric acid solution is used, the concentration is from about 1% to 15% by weight, and preferably from about 3% to 10% by weight; the temperature is from about 10° C. to 60° C., and preferably from about 25° C. to 40° C.

In performing the electrolytic processing of this invention, the carbon fiber is continuously passed through the aqueous sulfuric acid salt solution, in which the carbon fiber is used as an anode, and as the cathode, metal, graphite, or the like is used.

The electrolytic surface-treatment of this invention is carried out at a current density of from about 0.05 to 0.5 $A/m^2$, and preferably at from about 0.1 to 0.4 $A/m^2$, and in such a manner that the product of the current density ($A/m^2$), voltage (V), and processing time (min) is from about 0.02 to 8 A-V-min/$m^2$. The voltage is usually from about 1 to 20 volts, and preferably from about 2 to 10 volts. By the term "current density" as used herein is meant the current flowing per unit surface area of the carbon fiber to be surface-treated in the aqueous sulfuric acid salt solution.

When the current density is less than 0.05 $A/m^2$, the adhesion of the carbon fiber to resins is insufficiently improved. On the other hand, when it is greater than 0.5 $A/m^2$, the tensile strength and heat-oxidation resistance of the carbon fiber is undesirably reduced.

Furthermore, when the product of the current density ($A/m^2$), voltage (V), and processing time (min) is less than 0.02 A-V-min/$m^2$, the improvement in the adhesion of the carbon fiber to resins is insufficient, whereas when it is greater than 8 A-V-min/$m^2$, a carbon fiber having poor tensile strength and heat-oxidation resistance is undesirably obtained.

When the voltage is less than 1 volt, the decomposition voltage cannot be obtained, resulting in no occurrence of electrolytic decomposition. On the other hand, when it is greater than 20 volts, the energy loss is large and the operation becomes undesirably complicated.

High strength carbon fiber samples were surface-treated by the method of this invention and the previously known method. The contents explained above are summarized and shown in Table 1 below.

TABLE 1

| Electrolyte | Current Density ($A/m^2$) | Product of Current Density, Voltage and Processing Time (A-V-min/$m^2$) | Properties of Carbon Fiber After Surface-Treatment |
|---|---|---|---|
| Sulfate | Less than 0.05 | 0.02 to 8 | Poor adhesion |
| Sulfate | 0.05 to 0.5 | less than 0.02 | Poor adhesion |
| Sulfate | 0.05 | 0.02 to 8 | Excellent adhesion, and high strength and heat-oxidation resistance |
| Sulfate. | 0.05 to 0.5 | More than 8 | Poor strength and heat-oxidation resistance |
| Sulfate | More than 0.5 | 0.02 to 8 | Poor strength and heat-oxidation resistance |
| Sodium Hydroxide | 0.05 to 0.5 | 0.02 to 8 | Reduction of heat-oxidation resistance due to attachment of electrolyte on fiber |
| Sodium Hydroxide | More than 0.5 | 0.02 to 8 | Very low strength and heat-oxidation resistance |
| Sulfuric Acid | 0.05 to 0.5 | 0.02 to 8 | Poor strength and heat-oxidation resistance; and adverse influences of electrolyte on fiber onto hardening of epoxy resin |
| Sulfuric Acid | More than 0.5 | 0.02 to 8 | Very low strength and heat-oxidation resistance; and adverse influences on hardening of epoxy resin |
| Phosphoric Acid | 0.05 to 0.5 | 0.02 to 8 | very low strength and heat-oxidation resistance; and adverse influences on hardening of epoxy resin |

As can be seen from Table 1, the surface-treatment of a high strength carbon fiber in accordance with this invention provides a carbon fiber exhibiting excellent adhesion properties to resins and having high tensile strength and heat-oxidation resistance.

The thus-treated carbon fiber is then washed with water to remove the sulfuric acid salt remaining thereon. In view of adverse influences exerted by the residual sulfuric acid salt, it is preferred to reduce the amount of the residual electrolyte to about 2,000 ppm or less.

Referring to FIG. 1, which shows an apparatus for use in the practice of this invention, a carbon fiber 2 travels through a feed anode roll 1 and then through processing bath rolls 3 and 6 to a take-off roll 7. The reference numerals 4 and 5 indicate an aqueous sulfuric acid salt solution and a cathode plate, respectively. The feed roll 1 and the cathode plate 5 can be made of metal or graphite. The rolls 3 and 6 are made of a non-conductive material, such as plastic.

Figure 2:
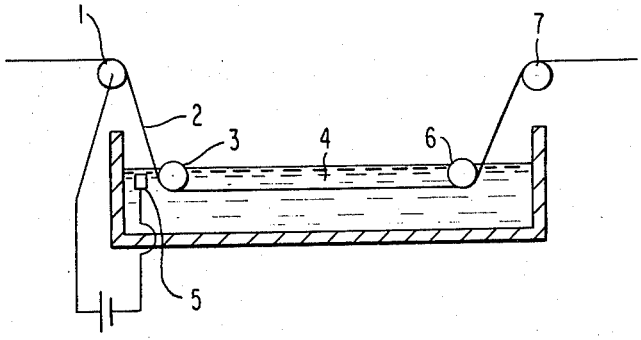
FIG. 2 is a schematic illustration in section of an apparatus in which a carbon fiber is surface-treated by electrolysis according to another embodiment of this invention.

FIG. 2 illustrates another embodiment in which the cathode plate 5 is placed near the position where the carbon fiber 2 introduced into the aqueous sulfuric acid salt solution 4. This apparatus increases the surface-treatment effect.

The surface-treated carbon fiber thus obtained is suitable for use in combination with various plastics, such as thermosetting resins, e.g., an epoxy resin, an unsaturated polyester resin, and a phenol resin, and thermoplastic resins, e.g., a polyamide resin, a polyacetal resin, and a polysulfone resin.

Hereinafter, the invention will be explained in greater detail by reference to the following Examples, although the invention is not limited thereby. All parts are by weight unless otherwise indicated.

EXAMPLE 1

Eight carbon fiber strands (tensile strength: 380 Kg/mm$^2$; tensile modulus: 24,000 Kg/mm$^2$; single filament diameter: 7.1 $\mu$m; single filament number/strand: 6,000) which had been produced from an acrylic fiber (Beslon CA, produced by Toho Beslon Co., Ltd.) were continuously introduced into an 8% by weight aqueous solution of ammonium sulfate (pH: 3.5; temperature: 25° C.) by the use of an apparatus as illustrated in FIG. 1 wherein the immersed length was 1.7 m, and they were treated with themselves as the anode under the conditions indicated in Table 2. Subsequent to the surface-treatment, the carbon fiber was continuously washed with water, and then dried. For the thus-obtained carbon fiber, the amount of the ammonium sulfate remaining thereon was 150 ppm.

The carbon fiber thus-obtained was measured with respect to tensile strength, heat-oxidation resistance, and interlaminar shear strength (I.L.S.S.). The results are indicated in Table 2.

"Tensile strength" as used herein indicates the tensile strength of a composite including fibers in the form of a strand, which was prepared by impregnating the strand with a mixture of 3 parts of boron trifluoride monomethylamine, 1 part of benzylmethylamine, and 96 parts of an epoxy resin (Epikote 828, produced by Shell Corp.) so that the fiber volume content after hardening was 60%, and then heat-treating the impregnated strand at 100° C. for 2 hours, at 150° C. for 30 minutes, and then at 170° C. for 10 minutes.

I.L.S.S. was measured using a 3 mm thick plate-like composite which was obtained by impregnating a strand with a mixture of 500 parts of diglycidyl phthalate and 445 parts of Methyl Nadie Anhydride so that the fiber volume content after hardening was 62%, to prepare a prepreg in which the fibers were orientated in one direction, laminating such prepregs in such a manner that the fibers were arranged in one direction, and then by heat-hardening the laminated prepregs at 120° C. for 40 minutes, and then at 180° C. for 2 hours under a load of 7 Kg/cm$^2$.

The measurement of the strand tensile strength was performed at a specimen length of 130 mm and a cross head speed of 1.3 mm/min by the use of an Instron tester (Model 1125, produced by Instron Corp.). I.L.S.S. was measured by a three-point bending short beam method at L/d=4 (L indicates a span length and d indicates the thickness of the plate-like composite) and a cross head speed of 1.3 mm/min (ASTM D2344-72).

In measuring the heat-oxidation resistance, 2 g of a carbon fiber sample was heat-treated lin air at 500° C. for 3 hours, and the value indicates the weight ratio (%) of the residual carbon fiber to the original carbon fiber.

TABLE 2

| | Surface-Treatment Conditions | | | | Performance of Fiber Obtained | | |
|---|---|---|---|---|---|---|---|
| | Voltage (I) (V) | Current Density (II) (A/m$^2$) | Processing Processing (III) (min) | Product of (I), (II), and (III) (A-V-min/m$^2$) | Tensile Strength (Kg/mm$^2$) | T.L.S.S. (Kg/mm$^2$) | Heat-Oxidation Resistance (%) |
| The Invention | 2.6 | 0.08 | 1.7 | 0.35 | 381 | 10.8 | 91 |
| | 3.0 | 0.17 | 1.7 | 0.87 | 379 | 11.1 | 89 |
| | 4.2 | 0.28 | 1.7 | 2.00 | 377 | 11.3 | 89 |
| Comparative Example | | | Original Fiber | | 380 | 7.5 | 92 |
| | 2.0 | 0.03 | 1.7 | 0.10 | 380 | 8.6 | 92 |
| | 4.4 | 0.55 | 1.7 | 4.11 | 350 | 11.3 | 85 |
| | 6.3 | 1.27 | 1.7 | 13.6 | 310 | 11.5 | 75 |
| | 3.0 | 0.17 | 0.02 | 0.01 | 379 | 8.9 | 92 |
| | 3.0 | 0.17 | 20.0 | 10.0 | 298 | 11.5 | 73 |

As can be seen from Table 2, with the fibers obtained under the conditions that the current density was from 0.05 to 0.5 A/m$^2$ and the product of the current density (A/m$^2$), voltage (V), and processing time (min) was from 0.02 to 8 A-V-Min/m$^2$, the strength and heat-oxidation resistance were high, and the I.L.S.S. value indicating the adhesion of the fiber to resins was also high.

EXAMPLE 2

Eight carbon fiber strands (tensile strength: 395 Kg/mm$^2$; tensile modulus: 24,500 Kg/mm$^2$; single filament diameter; 7.0 $\mu$m; and single filament number/strand: 3,000) which had been produced from an acrylic fiber (Beslon CA, produced by Toho Beslon Co., Ltd.) were treated in 10% by weight aqueous solutions of ammonium sulfate, ammonium hydrogensulfate, sodium sulfate, sodium hydrogen-sulfate, and a mixture of ammonium sulfate and ammonium hydrogensulfate (1:1, by weight) (pH: 3.5, 3.0, 7.0, 5.5, and 3.6, respectively; and temperature: all 28° C.), and after water-washing, dried.

The amount of the sulfuric acid salt remaining on the surface of the carbon fiber obtained, I.L.S.S., and the heat-oxidation resistance were measured, and the results are shown in Table 3.

TABLE 3

| Type of Electrolyte | Surface-Treatment Conditions: Voltage (I) (V) | Current Density (II) ($A/m^2$) | Processing Time (III) (min) | Product of (I), (II), and (III) ($A\text{-}V\text{-}min/mm^2$) | Performance of Fiber Obtained: Amount of Residual Sulfate (ppm) | Tensile Strength ($Kg/mm^2$) | I.L.S.S. ($kg/mm^2$) | Heat-Oxidation Resistance (%) |
|---|---|---|---|---|---|---|---|---|
| Ammonium Sulfate | 2.5 | 0.06 | 2 | 0.3 | 120 | 395 | 10.8 | 92 |
| Ammonium Sulfate | 3.1 | 0.18 | " | 1.12 | 125 | 393 | 11.1 | 91 |
| Ammonium Sulfate | 4.1 | 0.43 | " | 3.53 | 130 | 393 | 11.3 | 90 |
| Ammonium Hydrogen-Sulfate | 2.5 | 0.06 | " | 0.3 | 110 | 396 | 10.9 | 92 |
| Ammonium Hydrogen-Sulfate | 3.1 | 0.17 | " | 1.05 | 120 | 392 | 11.1 | 92 |
| Ammonium | 4.1 | 0.42 | " | 3.44 | 105 | 395 | 11.2 | 90 |
| Sodium Sulfate | 2.5 | 0.07 | " | 0.35 | 125 | 394 | 10.1 | 90 |
| Sodium Sulfate | 3.1 | 0.19 | " | 1.18 | 131 | 393 | 10.7 | 87 |
| Sodium Sulfate | 4.1 | 0.44 | " | 3.61 | 134 | 393 | 10.9 | 88 |
| Sodium Hydrogen-Sulfate | 2.5 | 0.07 | " | 0.35 | 120 | 390 | 10.2 | 90 |
| Sodium Hydrogen-Sulfate | 3.1 | 0.19 | " | 1.18 | 131 | 392 | 10.6 | 88 |
| Sodium Hydrogen-Sulfate | 4.1 | 0.44 | " | 3.61 | 125 | 394 | 11.0 | 87 |
| Mixed Sulfate | 2.5 | 0.06 | " | 0.3 | 125 | 394 | 10.9 | 93 |
| Mixed Sulfate | 3.1 | 0.18 | " | 1.12 | 130 | 393 | 11.1 | 92 |
| Mixed Sulfate | 4.1 | 0.43 | " | 3.53 | 125 | 392 | 11.4 | 92 |

As can be seen from Table 3, the use of ammonium sulfate, ammonium hydrogensulfate or a mixture thereof as an electrolyte provided a carbon fiber having somewhat higher I.L.S.S. and heat-oxidation resistance.

EXAMPLE 3

Carbon fibers were surface-treated in the same manner as in Example 1 except that sodium hydroxide, phosphoric acid, sulfuric acid, sodium sulfate, or ammonium hydrogensulfate was used in place of ammonium sulfate as an electrolyte, and then was washed with water and dried. The amount of the electrolyte remaining on the carbon fiber thus-obtained was measured. The results are shown in Table 4 together with surface-treatment conditions and the performance of the carbon fiber obtained. In all runs, the current density and processing time were 0.28 $A/m^2$ and 1 min, respectively. The performance of the carbon fiber was measured in the same manner as in Example 1.

TABLE 4

| Run No. | Surface-Treatment Conditions: Electrolyte | Voltage (V) | Product of Voltage, Current Density and Processing Time ($A\text{-}V\text{-}min/m^2$) | Performance of Carbon Fiber: Amount of Residual Electrolyte (ppm) | Tensile Strength ($Kg/mm^2$) | I.L.S.S. ($Kg/mm^2$) | Heat-Oxidation Resistance (%) |
|---|---|---|---|---|---|---|---|
| 1 | Sodium Sulfate | 4.2 | 1.2 | 500 | 380 | 11.2 | 93 |
| 2 | Sodium Sulfate | 4.2 | 1.2 | 1030 | 379 | 11.3 | 90 |
| 3 | Sulfuric Acid | 3.5 | 1.0 | 630 | 368 | * | 89 |
| 4 | Sulfuric Acid | 3.5 | 1.0 | 1150 | 365 | * | 88 |
| 5 | Phosphoric Acid | 3.5 | 1.0 | 570 | 360 | * | 94 |
| 6 | Phosphoric Acid | 3.5 | 1.0 | 1090 | 363 | * | 96 |
| 7 | Sodium Hydroxide | 3.4 | 0.9 | 205 | 358 | 11.3 | 23 |
| 8 | Sodium Hydroxide | 3.4 | 0.9 | 400 | 355 | 11.3 | 2 |

*Measurement was not possible because of insufficient hardening.

As can be seen from Table 4, when the surface-treatment was performed under such conditions that the current density and the product of current density, voltage, and processing time were within the ranges of this invention, and sodium sulfate was used as an electrolyte (Run Nos. 1 and 2), a carbon fiber having high heat-oxidation resistance, strength, and excellent adhesion properties could be obtained although a small amount of the electrolyte remained on the carbon fiber. On the other hand, when sulfuric acid or phosphoric acid was used as the electrolyte, no sufficient hardening of an epoxy resin occurred and the I.L.S.S. could not be measured. Similarly, when sodium hydroxide was used as the electrolyte, the heat-oxidation resistance of the carbon fiber was very low, even though the amount of the residual sodium hydroxide was relatively small.

EXAMPLE 4

The carbon fibers obtained in Example 3 (Run Nos. 1 to 8) were washed under identical conditions with respect to each other after the surface-treatment and dried. Then, the amount of the electrolyte remaining on the carbon fiber was measured. The results are shown in Table 5.

TABLE 5

| Run No. | Electrolyte | Amount of Residual Electrolyte (ppm) |
|---|---|---|
| 1 | Sodium Sulfate | 25 |
| 2 | Sodium Sulfate | 29 |
| 3 | Sulfuric Acid | 50 |
| 4 | Sulfuric Acid | 55 |
| 5 | Phosphoric Acid | 48 |
| 6 | Phosphoric Acid | 60 |
| 7 | Sodium Hydroxide | 120 |
| 8 | Sodium Hydroxide | 125 |

The amount of the sodium sulfate remaining on the carbon fiber was the least as compared with the other hydrolytes. On the other hand, the amount of the sodium hydroxide remaining on the carbon fiber was the largest; thus it was found that sodium hydroxide has the strongest tendency of remaining on the carbon fiber.

EXAMPLE 5

Eight carbon fiber strands (tensile strength: 345 Kg/mm$^2$; tensile modulus: 27,000 Kg/mm$^2$; single filament diameter: 6.8 $\mu$m; and single filament number/strand: 12,000) which had been produced from an acrylic fiber (Beslon CA, produced by Toho Beslon Co., Ltd.) were continuously introduced into a 5% by weight aqueous solution of ammonium hydrogensulfate (pH: 3; temperature: 35° C.) in an apparatus as shown in FIG. 2 wherein the immersed length was 1.3 m. Surface-treatment was performed with the carbon fiber as an anode and under the conditions that the current density was 0.2 A/m$^2$ and the product of current density, voltage and processing time was 3.0 V$\times$0.2 A/m$^2\times$0.9 min=0.5 A-V-min/m$^2$. The carbon fiber thus obtained was continuously washed with water and dried.

The amount of the ammonium hydrogensulfate remaining on the surface of the thus-obtained carbon fiber was 185 ppm. The tensile strength, I.L.S.S., and heat-oxidation resistance were, respectively, 342 Kg/mm$^2$, 11.4 Kg/mm$^2$, and 98%. Thus, the carbon fiber had high strength and heat-oxidation resistance, and excellent adhesive properties to resins.

EXAMPLE 6

Eight carbon fiber strands (tensile strength: 392 Kg/mm$^2$; tensile modulus: 26,500 Kg/mm$^2$; tensile filament diameter: 7.1 $\mu$m; and single filament number/strand: 12,000) which had been produced from an acrylic fiber (Beslon CA, produced by Toho Beslon Co., Ltd.) were introduced into an apparatus as shown in FIG. 2 wherein the immersed length was 3 m and the electrolyte was a 8% aqueous solution of ammonium sulfate (pH: 3.8; temperature: 42° C.). Surface-treatment was performed under the conditions indicated in Table 6, and thereafter the carbon fiber was washed with water and dried.

The amount of the ammonium sulfate remaining on the surface of the carbon fiber obtained, I.L.S.S., and heat-oxidation resistance were measured, and the results are shown in Table 6. The I.L.S.S. and heat-oxidation resistance were measured in the same manner as in Example 1.

TABLE 6

| | Surface-Treatment Conditions | | | Performance of Carbon fiber Obtained | | | |
|---|---|---|---|---|---|---|---|
| Run No. | Voltate (V) | Current Density (A/m$^2$) | Product of Voltage, Current Density and Processing Time (V-A-min/m$^2$) | Amount of Residual Electrolyte (ppm) | Tensile Strength (Kg/mm$^2$) | I.L.S.S. (Kg/mm$^2$) | Heat-Oxidation Resistance (%) |
| 1 | — | — | — | — | 392 | 4.2 | 98 |
| 2 | 2.5 | 0.2 | 1.5 | 120 | 391 | 10.8 | 98 |
| 3 | 2.5 | 0.3 | 2.2 | 121 | 288 | 11.0 | 97 |
| 4 | 3.5 | 0.35 | 3.7 | 125 | 388 | 11.1 | 98 |
| 5 | 4.5 | 0.38 | 5.1 | 110 | 390 | 11.3 | 97 |
| 6 | 3.5 | 0.35 | 7.4 | 124 | 383 | 11.4 | 96 |
| 7 | 4.5 | 0.38 | 10.2 | 118 | 375 | 11.4 | 90 |

As can be seen from Table 6, the carbon fibers surface-treated according to this invention (Run Nos. 2 to 6) had excellent tensile strength, I.L.S.S., and heat-oxidation resistance.

While the invention has been described in detail and with reference to specific embodiment thereof, it will be apparent to one skilled in the art that various changes and modifications can be made therein without departing from the spirit and scope thereof.

What is claimed is:

1. A method for surface-treating high strength carbon fiber comprising passing an electrical current through the carbon fiber in an aqueous solution of a sulfate under conditions such that the current density is from about 0.05 to 0.5 amps/meter$^2$ (A/m$^2$), and the product of the current density, voltage (V), and processing time (min) is from about 0.02 to 8 A-V-min/m$^2$, while continuously moving the carbon fiber as an anode in the aqueous solution, wherein the high strength carbon fiber has a tensile modulus of from about 20,000 to 28,000 Kg/mm$^2$ and a tensile strength of at least about 250 Kg/mm$^2$.

2. A method as in claim 1 wherein the sulfate is at least one member selected from the group consisting of ammonium sulfate, ammonium hydrogensulfate, sodium sulfate, and sodium hydrogensulfate.

3. A method as in claim 1 wherein the sulfate is at least one member selected from the group consisting of ammonium sulfate and ammonium hydrogensulfate.

4. A method as in claim 1 wherein the current density is from about 0.1 to 0.4 $A/m^2$.

5. A method as in claim 1 wherein the temperature of the aqueous sulfate solution is from about 10° C. to 60° C.

6. A method as in claim 1 wherein the concentration of the sulfate in the aqueous solution is from about 1% to 15% by weight.

7. A method as in claim 1 wherein the voltage is from about 1 to 20 volts.

8. A method as in claim 1 wherein the carbon fiber is produced from an acrylic fiber.

9. A method as in claim 1 wherein after the electrical treatment the carbon fiber is washed with water to remove the sulfuric acid salt.

10. A method as in claim 10 wherein the water-washing is performed until the amount of the sulfate remaining on the carbon fiber is about 2,000 ppm or less.

11. A carbon fiber exhibiting excellent adhesive properties to resins and having high strength and heat-oxidation resistance produced by a method comprising passing an electrical current through the carbon fiber in an aqueous solution of a sulfate under conditions such that the current density is from about 0.05 to 0.5 amps/meter$^2$ ($A/m^2$), and the product of the current density, voltage (V), and processing time (min) is from about 0.02 to 8 A-V-min/$m^2$, while continuously moving the carbon fiber as an anode in the aqueous solution, wherein the high strength carbon fiber has a tensile modulus of from about 20,000 to 28,000 $Kg/mm^2$ and a tensile strength of at least about 250 $Kg/mm^2$.

* * * * *